US008288694B2

(12) United States Patent
Ristola et al.

(10) Patent No.: US 8,288,694 B2
(45) Date of Patent: Oct. 16, 2012

(54) APPARATUS FOR MICROWAVE HEATING OF PLANAR PRODUCTS

(75) Inventors: Pete Ristola, Lammi (FI); Jaakko Vilo, Turku (FI); Jerzy Piotrowski, Warsaw (PL)

(73) Assignee: Raute Oyj, Nastola (FI)

( * ) Notice: Subject to any disclaimer, the term of this patent is extended or adjusted under 35 U.S.C. 154(b) by 697 days.

(21) Appl. No.: 12/554,603

(22) Filed: Sep. 4, 2009

(65) Prior Publication Data

US 2010/0059510 A1 Mar. 11, 2010

(30) Foreign Application Priority Data

Sep. 11, 2008 (FI) ..... 20085857

(51) Int. Cl.
*H05B 6/70* (2006.01)
*H01P 5/08* (2006.01)

(52) U.S. Cl. ..... 219/691; 219/698; 219/702; 333/125; 333/137; 333/248

(58) Field of Classification Search ..... None
See application file for complete search history.

(56) References Cited

U.S. PATENT DOCUMENTS 3,851,132 A * 11/1974 VanKoughnett ..... 219/693
5,278,375 A * 1/1994 Berteaud et al. ..... 219/693
6,020,580 A 2/2000 Lewis et al.
6,693,266 B1 * 2/2004 Yagi ..... 219/695
8,173,943 B2 * 5/2012 Ristola et al. ..... 219/690

FOREIGN PATENT DOCUMENTS

| | | |
|---|---|---|
| CA | 2443799 | 10/2003 |
| EP | 0940060 B1 | 2/2007 |
| GB | 893936 | 4/1962 |
| GB | 1016435 | 1/1966 |
| WO | 2008150644 A2 | 12/2008 |

* cited by examiner

*Primary Examiner* — Alonzo Chambliss
(74) *Attorney, Agent, or Firm* — Mendelsohn, Drucker, & Associates, P.C.

(57) ABSTRACT

In a microwave heating apparatus, the fundamental $TE_{10}$ mode of the standard waveguide (5) having a standard rectangular cross-section is fed into an elongated heating cavity (2) having an enlarged rectangular cross-section in which the shorter side of the standard waveguide is enlarged to a length which can accommodate the desired width of a board (8) to be heated. A pair of lateral slots (25) is provided parallel in the opposite enlarged walls (11) of the heating cavity (2) to form a track for the board (8) to travel across the cavity. As the initially longer sidewall (11) of the standard waveguide is unchanged, the fundamental mode is not affected but the electric field is uniformly distributed along the width of the board (8) traversing the electric field and the cavity. As a result, wider products can be heated and a more uniform heating pattern can be achieved.

19 Claims, 8 Drawing Sheets

APPARATUS FOR MICROWAVE HEATING OF PLANAR PRODUCTS

FIELD OF THE INVENTION

The invention relates to microwave heating of planar products, particularly wood panels and boards.

BACKGROUND OF THE INVENTION

A pressed-wood composite product can be produced from a prepared pre-assembly mat which includes selected wood components along with intercomponent, heat-curable adhesive. A typical end product may, for example be plywood, or laminated veneer lumber (LVL), which, after production can be cut for use, or otherwise employed, in various ways as wood-based building components. The starter material would typically be, in addition to a suitable heat-curable adhesive, (a) thin sheet veneers of wood, (b) oriented strands (or other fibrous material) of smaller wood components, (c) already pre-made expanses of plywood which themselves are made up of veneer sheets or (d) other wood elements.

In conventional LVL fabrication processing, LVL is typically made of glued, veneer sheets of natural wood, utilizing adhesives, such as urea-formaldehyde, phenol, resolsenidi, formaldehyde formulations which require heat to complete a curing process or reaction. There are several well-known and widely practiced methods of manufacturing and processing to create LVL. The most common pressing technology involves a platen press, and a method utilizing such a press is described in U.S. Pat. No. 4,638,843. Pressing and heating is typically accomplished by placing precursor LVL between suitable heavy metal platens. These platens, and their facially "jacketed" wood-component charges, are then placed under pressure, and are heated with hot oil or steam to implement the fabrication process. Heat from the platens is slowly transferred through the wood composite product, the adhesive cures after an appropriate span of pressure/heating time. This process is relatively slow, the processing time increasing with the thickness of the product.

U.S. Pat. No. 5,628,860 describes an example of a technique wherein radio frequency (RF) energy is added to the environment within (i.e., in between) opposing press platens to accelerate the heating and curing process and thereby shorten fabrication times.

Still another technique to provide the heating and curing is to utilize microwave energy. In U.S. Pat. No. 5,895,546, discloses use of microwave energy to preheat loose LVL lay-up materials, which are then finished in a process employing a hot-oil-heated, continuous-belt press. Also CA 2 443 799 discloses a microwave preheat press. A microwave generator feeds through a waveguide a microwave applicator such the microwave energy is applied to an initial press section which leads into a final press section. Multiple waveguides in a staggered configuration may be used to provide multiple points of application of the microwave energy with a waveguide spacing that yields substantially uniform heating pattern. Heating temperature is adjusted by varying the linear feed rate at which the wood element enters the microwave preheat press, or by controlling the microwave waveform.

EP0940060 discloses another microwave preheat press wherein the microwave energy is feed through waveguide to applicators on both sides of the wood product. The feeding waveguides are provided with sensor for measuring reflected microwave energy, and a tuner section for generating an induced reflection which cancels the reflected energy. The tuner section includes tuning probes whose length within the feeding waveguides are adjusted by a stepper motor.

U.S. Pat. No. 6,744,025 discloses a microwave heating unit formed into a box-like resonant cavity via which the product to be heated is passed. The product is passed via a narrow gap that extends lengthwise through the entire cavity and divides the cavity substantially at the midline of the cavity into two opposed subcavities. The microwave energy to be imposed on the product is fed via a waveguide to one of the subcavities.

U.S. Pat. No. 7,145,117 discloses an apparatus for heating a board product containing glued wood. The apparatus comprises a heating chamber through which the board product passes and in which a microwave heating electrical field is provided to prevail substantially on the board plane, in transversa) direction with respect to the proceeding direction of the board, by means of a microwave frequency energy applied perpendicular to the board plane.

GB893936 discloses a microwave heating apparatus wherein a resonant cavity is formed by a segment of a standard waveguide which is a rectangular in transverse cross-section with a longer side and a shorter side. The cavity is coupled to the waveguide through an adjustable matching iris forming one end of the cavity. The cavity can be tuned by means of an adjustable short circuiting piston serving as the other end wall of the cavity. Two opposite longer sides of the standard waveguide cavity are further provided with slots extending lengthwise of the cavity to allow a planar product pass through the cavity between adjustable side plates located on the opposite shorter sides of the cavity. The side plates shorten the longer sides of the cavity with respect to the respective sides of the standard waveguide such that the waveguide segment of cut-off frequency close to an operating frequency is formed. End parts of the cavity beyond the side plates have cross-sectional dimensions of the standard waveguide. A sensor is provided to measure the energy reflected from the cavity. The frequency is tuned so that the energy reflected from the cavity is a minimum. Side plates are then adjusted so as to produce a uniform field across the width of the planar product to be heated. This prior art structure has various drawbacks.

1. The prior art structure is suitable only for heating products with very limited cross-section. The thickness of the heated product shall not exceed 10 to 15% of length of the longer side of the standard waveguide. The width of the heated product (along the longitudinal axis of the cavity) should not be longer than length of the longer side of the standard waveguide.

2. The heating occurs on a distance (along the direction of movement of the heated product) that is equal to the length of the shorter side of the waveguide.

3. Losses in the waveguide metal increases strongly when the operating frequency goes to the cut-off frequency of the cavity.

4. The cavity has a low Q factor. Insertion of the material to be heated into the cavity will additionally degrade the Q factor of the cavity. This results in non-uniform heating pattern and destruction of the resonant phenomenon.

Also GB1016435 discloses a microwave heating apparatus intended to improve the structure of GB893936. GB1016435 notes as a disadvantage of GB893936 that adjustment of the tuning plunger and adjustment of the iris affect not only the tuning of cavity but also the standing wave pattern in the cavity, and this militates against the provision of the desired uniform distribution of the electric field along the central part of the cavity. In GB1016435, a resonant cavity is formed by a waveguide having a rectangular cross-section with a longer side and a shorter side. The microwave energy is supplied into the cavity by means of a coaxial feeder and a coupling loop. The tuning of the cavity is performed by metal rods which extend lengthwise of the cavity. The waveguide or cavity terminates at each end in an effective open-circuit formed by a waveguide section having larger cross-sectional dimensions than the central cavity section. With this structure, the field intensity along the central cavity is alleged to be substantially uniform along the heating area. However, the structure of GB1016435 has the same disadvantages as listed for GB893936 above. Moreover, tuning by means of a metal rod is questionable, because the metal rod may create with the walls of the waveguide cavity a TEM transmission line of substantially different wavelength than the waveguide, and it may further degrade heating uniformity.

DISCLOSURE OF THE INVENTION

An object of the present invention is to provide a microwave heating apparatus which enables heating of larger variety of planar products than the prior art apparatuses. The object of the invention is achieved by an apparatus as recited in the independent claim. The preferred embodiments of the invention are disclosed in the dependent claims.

According to an aspect of the invention, a microwave power carried by the fundamental mode of the standard waveguide which is rectangular in transverse cross-section with a first side of length b and a second side of length a, wherein b<a, is fed into an elongated heating cavity having an enlarged rectangular cross-section with the first side of an extended length C*b and the second side of length a, wherein C>2 and C*b>a. The value of factor C may be selected depending on the width of the planar product to be heated. In other words, the shorter side of the standard waveguide is enlarged to a length which can accommodate the desired width of the product to be heated. A pair of lateral slots is provided parallel in the opposite enlarged first walls of the elongated heating cavity to form a track for a planar product to travel across the cavity. As the initially longer sidewall of the standard waveguide is unchanged, the cut-off frequency of the fundamental mode is not affected, and the electric field is uniformly distributed along the length C*b of the enlarged side, i.e. along the width of the planar product. As a result, wider products can be heated and a more uniform heating pattern can be achieved than in the prior art solutions.

According to an aspect of the invention, the elongated heating cavity is divided into opposed first and second subcavities by means the lateral slots and the product track. The fundamental mode is fed to the end of first subcavity via a coupling iris whose size in direction of the second side is reduced so as to minimize the power of fundamental mode which is reflected from the heating cavity towards a microwave source. In the direction of the first sidewall, the size of the coupling iris is preferably substantially unchanged in order to ensure uniform distribution of the electric field along this side. A frequency-tuning plate is provided to form the opposite end wall of the second subcavity. A frequency tuning device is arranged to move the end wall of the second subcavity in the axial direction so as to tune the frequency of the elongated heating cavity and to maintain the maximum or minimum of the fundamental mode electric field in the axial direction at about middle of thickness of the planar product. Thus, it possible to process the planar products in wide range of thicknesses with use of these two adjustments, without needing to change the physical dimensions of the applicator. The maximum or minimum heating point or points can be moved to a desired point in the thickness of the planar product. The desired maximum heating point may be at the middle of the thickness of the product in some cases, whereas it may be desired to focus the maximum heating to the top and bottom areas of the product in some other cases.

BRIEF DESCRIPTION OF THE DRAWINGS

In the following the invention will be described in greater detail by means of exemplary embodiments with reference to the attached drawings, in which.

DESCRIPTION OF EXEMPLARY EMBODIMENTS OF THE INVENTION

The present invention relates generally to an apparatus for heating a planar product, particularly a wooden board, panel or veneer product containing glued wood, primarily for affecting the hardening reactions of the glue, by applying the heating power to the planar product by means of an alternating electrical field at microwave frequency. Before the heating step, the board product has been manufactured to be continuous, and it is conveyed through a stationary heating apparatus. The board product generally comprises wood layers arranged parallel to the board, ply layers, the spaces between them being glued with glue to be hardened by means of heat. A typical product is the so-called LVL balk (Laminated Veneer Lumber). The invention is applicable to any types of wood based board products, in which the glued wood component is bound to a solid board construction by hardening the glue. Before being transported to heating, the board product may usually be exposed to pressure in order to get the glued wood components into a close contact and to remove air spaces disturbing the alternating electrical field in the board construction. These other devices, such as the conveyer and the press, are not described in detail herein.

Figure 1:
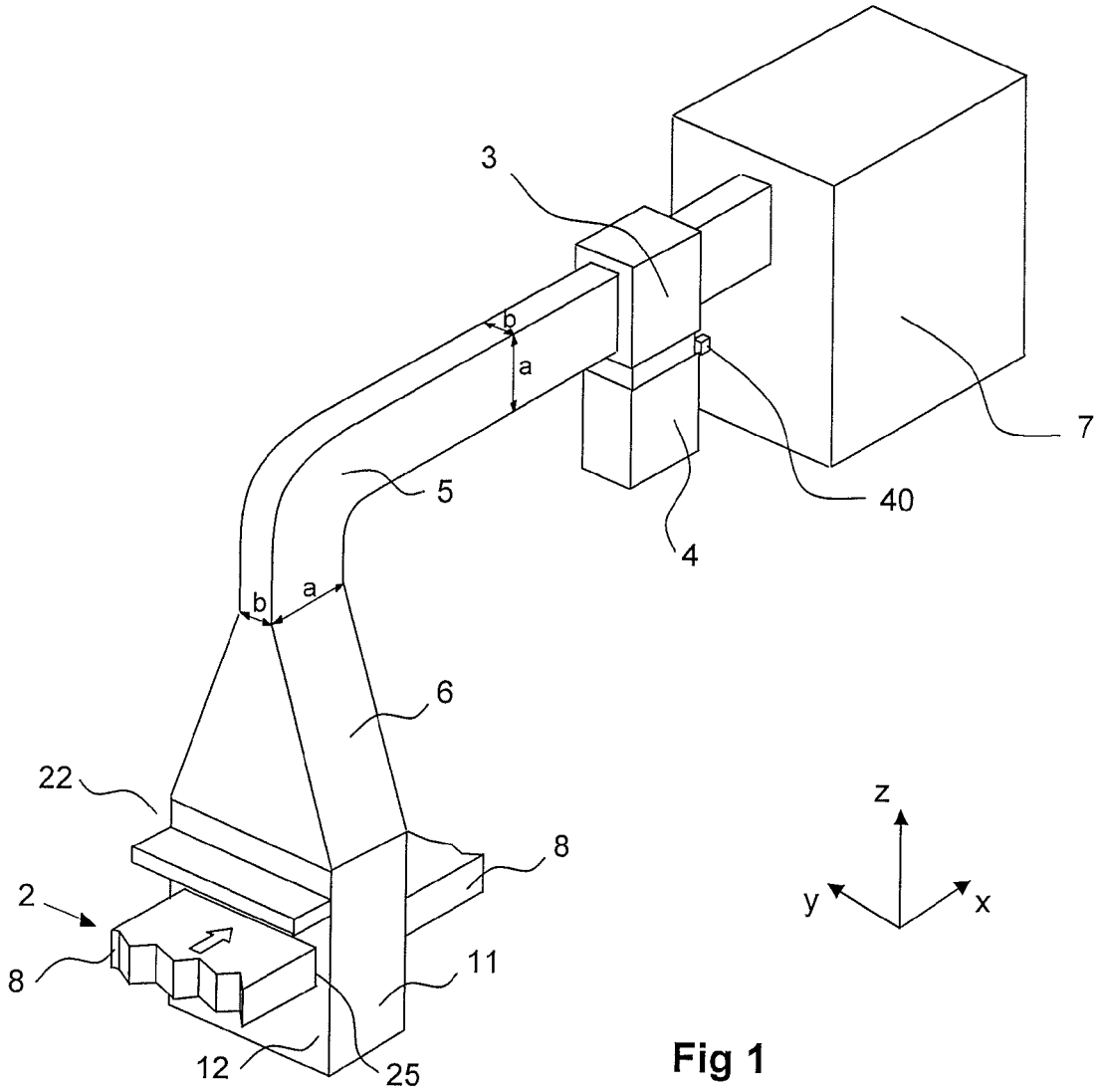
FIG. 1 illustrates an example structure of a heating apparatus according to an embodiment of the present invention.

An example structure of a heating apparatus is illustrated in FIG. 1. A microwave generator 7 may include both a power supply and a remote microwave source (such as a magnetron or a klystron). The generator 7 launches microwaves (e.g. 415 MHz, 915 MHz or 2450 MHz) to a circulator 3. The circulator 3 directs the microwave power from the generator 7 into a feeding waveguide 5, but directs the reflected microwave power returning from the applicator 2 by the feeding waveguide 5 to a water load 4, thereby protecting the generator from the reflected microwave power. Further, a sensor 40 for measuring the reflected microwave power is provided at an appropriate point along the return path to the water load 4.

The feeding waveguide 5 is dimensioned as a single-mode waveguide such that only the fundamental $TE_{10}$ (Transverse Electric) mode of microwave power propagates through the waveguide. The $TE_{10}$ mode is also called as a $H_{10}$ mode. The waveguide 5 is formed by a rectangular tube that has cross section a by b meters, with wall planes z-y and z-x. When an electromagnetic wave propagates down the waveguide in direction z (the longitudinal axis of the waveguide), the electric field has only y component (along the y-axis, i.e. the shorter lateral side of the rectangular cross-section of the standard rectangular waveguide). An example of suitable waveguide for the microwave of 915 MHz, is a standard waveguide WR975 with inside dimensions are b=124 mm and a=248 mm.

The output of the feeding waveguide 5 is connected to an input of a waveguide transition 6. The input end of the waveguide transition 6 has a rectangular cross section of a by b meters equal to that of the feeding waveguide 5, e.g. a=248 mm and b=124 mm. However, the output of the waveguide transition 6 has an enlarged cross-section C*b by a meters in which the length of side along y is enlarged by a factor C, wherein C>2, while a is unchanged. The value of factor C may be selected depending on the width of the planar product to be heated. In the example discussed below, the C*b=600 mm and a=248 mm. Transition between these waveguides of different cross-sections is implemented by a suitable manner such that substantially only the fundamental $TE_{10}$ mode exists in both waveguides. This condition ensures uniform distribution of the electric field intensity along the enlarged side Cab, e.g. 600 mm.

Figure 2:
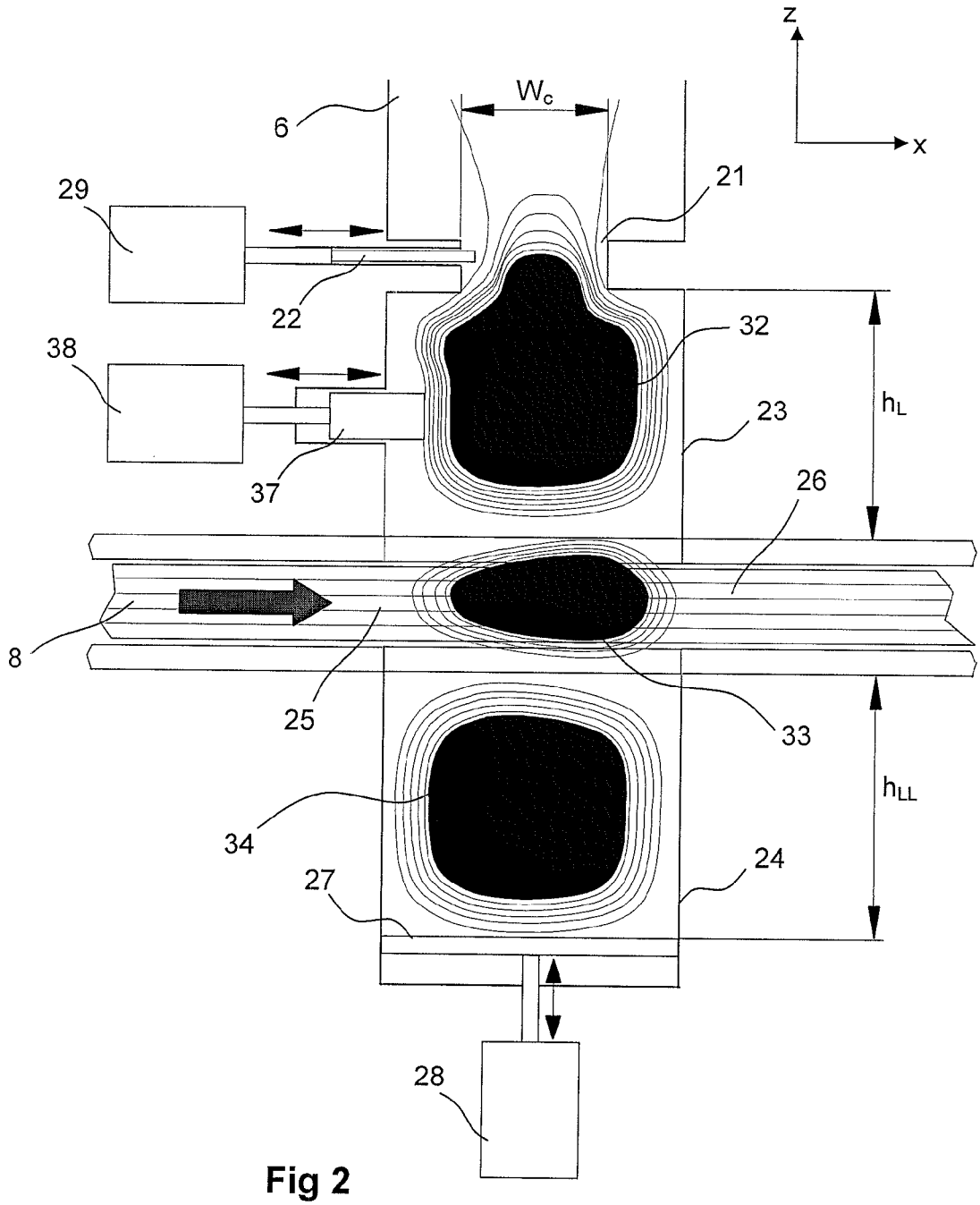
FIG. 2 shows a schematic cross-sectional view of an exemplary applicator 2 according to an embodiment of the invention in the x-z plane.
Figure 3:
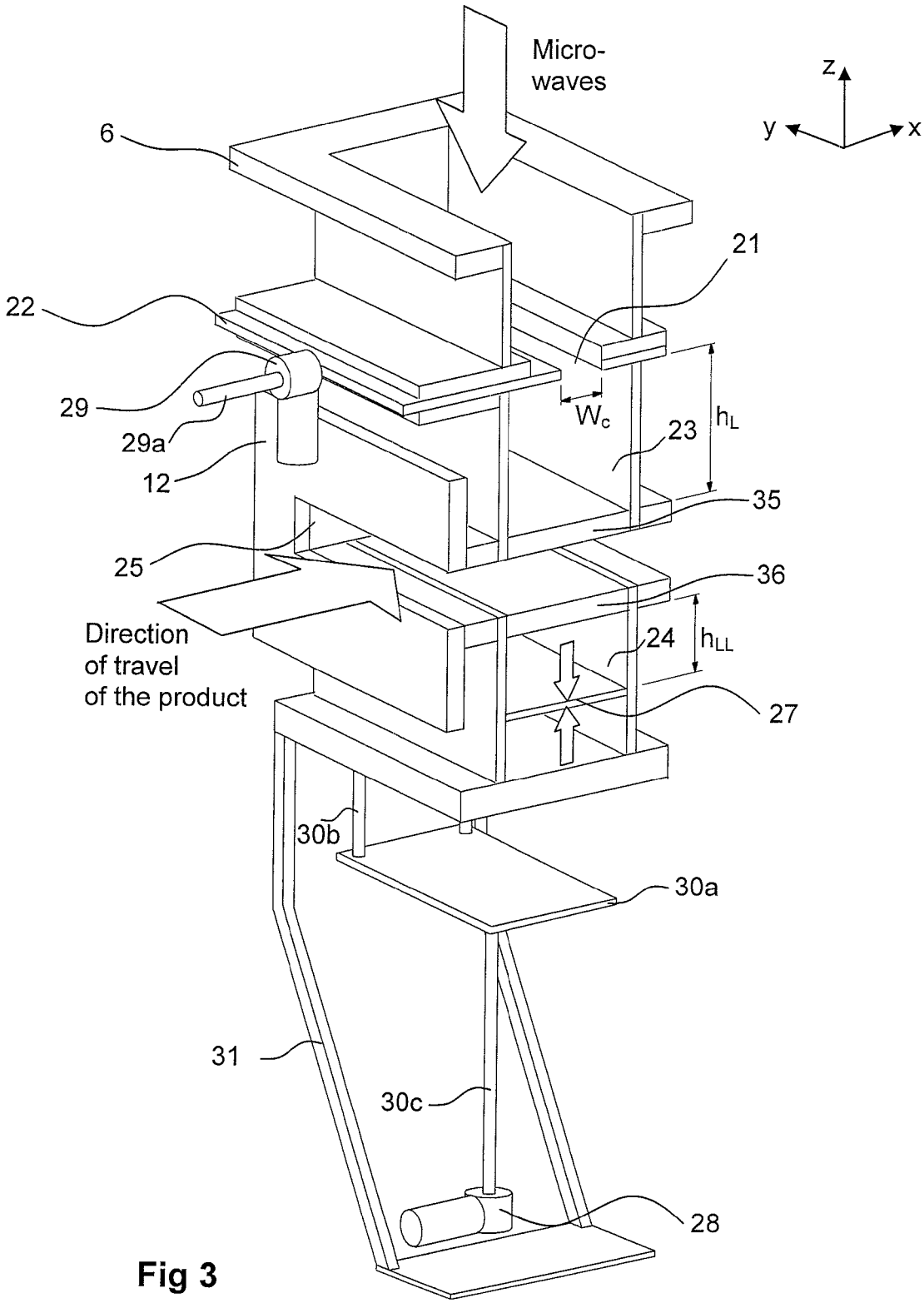
FIG. 3 shows a perspective cross-sectional view of an exemplary structure of the applicator 2 illustrated in FIGS. 1 and 2.

The output of the waveguide transition 6 is connected to an input of a heating cavity or microwave applicator 2 having the input cross-sectional dimensions C*b and a, e.g. C*b=600 mm and a=248 mm. FIG. 2 shows a schematic cross-sectional view of an exemplary applicator 2 according to an embodiment of the invention in the x-z plane. FIG. 3 shows a perspective cross-sectional view of an exemplary structure of for the applicator 2 illustrated in FIGS. 1 and 2.

The applicator 2 is implemented by a multi-half-wavelength cavity resonator divided into opposed first (upper) part 23 and second (lower) part 24 of the cavity resonator, i.e. subcavities, in the axial direction of the elongated cavity resonator by means of a pair of lateral slots 25 and 26 provided parallel in the opposite enlarged side walls 12 of applicator 2 to form a product track. The planar product 8 to be heated enters via the slot 25 into the cavity resonator, travels across the cavity resonator between the subcavities while being heated by the microwave power, and exits the cavity resonator via the slot 26 by means of a suitable conveyor or drive arrangement (not shown). A pressing system (not shown), such a metal piston press, may be located immediately after the applicator 2. In an embodiment of the invention, there are low-loss dielectric layers 35 and 36 at the bottom of upper subcavity 23 and at top of the lower subcavity 24, respectively, defining the product track between them. The layers 35 and 36 are preferably of Teflon or like material, and they provide a protection against the heat and pressure generated on the heated material track. It should be appreciated that although the applicator 2 is shown in a vertical position in these examples, it can be alternatively implemented in any inclined position, or in an opposite vertical position in which the second part is the upper subcavity and the first part 23 is the lower subcavity.

The waveguide transition 6 feeds microwave power to the upper subcavity through a coupling window 21, also referred to as an iris opening. The size of the coupling window 21 is adjustable by an iris tuner plate 22 so as to match the applicator. In the present invention, the width $W_c$ of the coupling window 21 is changed only in the direction x, i.e. in direction of sidewall 11 (e.g. the side 248 mm long). The y-dimension of the iris tuner plate is preferably substantially equal to the internal y-dimension of the subcavity, namely C*b (e.g. 600 mm). Such iris may also be called as an inductive iris as it affects mostly the magnetic field of the $TE_{10}$ mode. In the direction y, i.e. in the direction of sidewall 12 (e.g. the side 600 mm long), the size of the coupling window 21 must be substantially unchanged in order to ensure uniform distribution of the electric field along this side. To that end, in the example embodiment shown in FIGS. 1, 2 and 3, the iris tuner plate 21 is provided laterally on the sidewall 12 such that it can be moved in back and forth in the direction of x axis by means an actuator 29, such as a step motor or a hydraulic or pneumatic actuator. In FIG. 3, the step motor 29 moves the iris tuner plate 22 by means of the rod 29*a* connected to the tuner plate 22. The iris tuner plate 22 may be made of any non-magnetic electrically conductive material, such as aluminum, stainless steel, copper, etc. The iris tuner plate may be isolated from the walls of the waveguide by means of a suitable isolator, such as Teflon.

A frequency-tuning plate 27 made of any non-magnetic electrically conductive material, such as aluminum, stainless steel, copper, etc, is provided to form the bottom wall of the lower subcavity 24. The frequency-tuning plate 27 can be moved in a vertical direction z (the longitudinal axis of the applicator 2) so as to vary the height $h_{LL}$ of the lower subcavity 24 and to thereby tune the resonant frequency of the applicator 2. The movement of the tuning plane 27 is provided by means an actuator 28, such as a step motor or a hydraulic or pneumatic actuator. In FIG. 3, the step motor 28 moves a metal plane 30*a* by means of the rod 30*c*. The frequency tuner plane 27 is connected to the parallel metal plate 30*a* by vertical rods 30*b* and thus moves vertically with the plate 30*a* when the step motor 28 moves the metal plate 30*a* with a rod 30*c*. The reference numeral 31 denotes generally the stand of the applicator 2.

Figure 4:
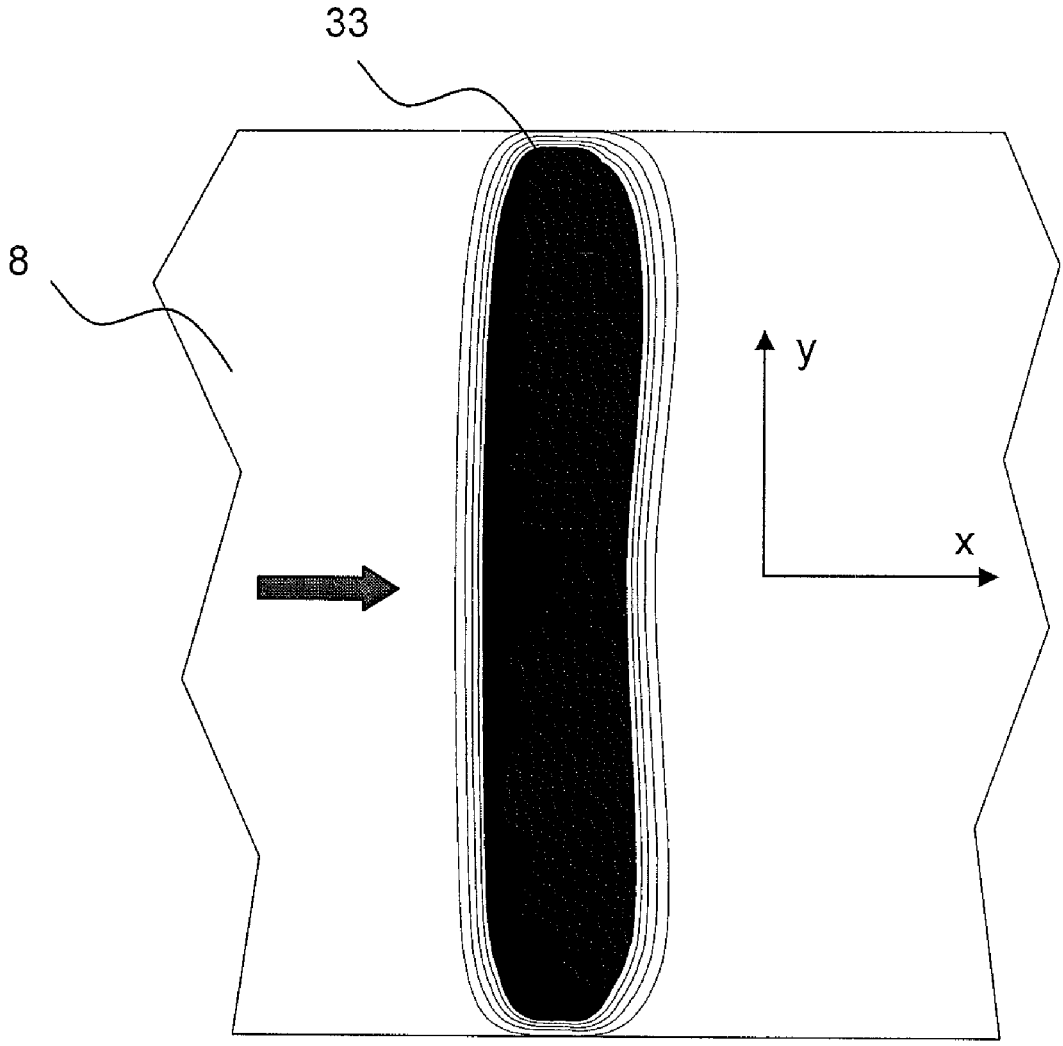
FIG. 4 shows a top view of the heating distribution at the middle of the planar product 8 in FIG. 1.

Let us now examine the operation of the apparatus shown in FIGS. 1, 2 and 3. As the $TE_{10}$ mode wave strikes the iris 21 from the waveguide transition 6, part of the wave will be reflected, while the remainder will enter the cavity 23. The transmitted wave will propagate downwards through the subcavities 23 and 24 until it strikes the metal plane 27 to induce a reflected wave propagating in the opposite upwards direction along the z-axis. When the first reflected wave encounters the iris plane 21, it will produce a second reflected wave which will propagate downwards along the z-axis, and so on. The interference between these the waves travelling in the opposite directions results in a standing wave inside the cavity. In FIG. 2, the electric field distributions 32, 33, and 34 of standing wave in a three-halves-wavelength cavity resonator are illustrated. The peak value of the electric field of the first half-wavelength 32 is located within the upper subcavity 23, and the peak value of the electric field of the third half-wavelength 34 is located within the lower subcavity 24. The peak value of the electric field of the second half-wavelength 33 is located at the middle of the thickness of the planar product 8 such that the maximum heating is positioned at this point. FIG. 4 shows a top view of the heating middle half-wavelength peak distribution 33 at the middle of the planar product 8. The heating pattern is uniformly distributed along the width of the planar product 8.

It should be appreciated that any number of half-wavelengths can be selected depending on the thickness of the planar product 8 and a desired position of maximum heating. If maximum heating is intended to be at the middle (in vertical direction) of the planar product (the product is symmetrically placed in the track), there is typically an odd number of half-wavelengths in the cavity. If the minimum heating is intended to be at the middle of the planar product 8 (bottom and top of the planar product are maximally heated), there is typically an even number of half-wavelengths in the cavity.

There are three parameters which fully describe the frequency characteristics of the cavity, namely the resonant frequency, the coupling coefficient and the quality factor (Q-factor). Changing the size of a coupling iris 21 changes the coupling coefficient. When the coupling coefficient is equal to 1, we have perfect matching of the cavity (no reflection). Moving the tuning plate 27 vertically changes the electrical length of the resonator and thereby the resonant frequency.

The multi-half-wavelength applicator according to the present invention makes it possible to process the planar products, in wide range of thicknesses, without changing the physical length of the lower part 24 of the applicator 2. The applicator 2 can be matched at a particular frequency with the use of the two tuners 22 and 27.

For example, an increase in the thickness of the planar product decreases the resonant frequency and the coupling coefficient of the applicator 2. In order to match the applicator 2 at the same frequency, the electrical length of the cavity have to be decreased. The electrical length is reduced when the frequency tuner 27 in the subcavity 24 is pushed upwards, i.e. towards the other subcavity 23. This change in the vertical position of the frequency tuner 27 provokes a rise in the resonant frequency and the shift up of the second electric field maximum 33 at product track of the applicator 2. A decrease in the size of the coupling window 21 slightly pushes the maximum of the electric field 33 downwards. Similarly, a decrease in the thickness of the planar product can be compensated by means of increasing the electrical length and the coupling window. These two mechanisms allow automatically keeping the maximum of the electric field 33 close to the middle of the planar product.

The tuning is based on the measured the reflected power. The reflection measurement may be carried out by the sensor 40 and indicated by a suitable power indicator, if the tuning is performed manually. The reflected power versus resonance frequency may also be displayed graphically by means of a suitable analyzer or analysis software run on a computer. In case of an automatic turning, the measured reflected power is provided to a control unit which provides the control signals for the tuners 22 and 27. At the startup phase, an exemplary tuning algorithm may be the following iterative process:

a) The coupling tuner 22 is fully out for the maximum opening of the coupling window 21;
b) The frequency tuner 27 is moved to a position where a minimum reflected power is observed;
c) The coupling tuner 22 is moved to a position where a minimum reflected power is observed;
d) The frequency tuner 27 is slightly moved to a position where minimum reflected power is observed;
e) The coupling tuner 22 is slightly moved to a position where a minimum reflected power is observed.
f) Steps d and e are repeated until the reflected power has decreased to a predetermined threshold level, or a predetermined number of times.

According to an embodiment of the invention, steps d-f are performed for fine-tuning during the heating operation if the measured reflected power exceeds a predetermined threshold level. There may be hysteresis between the threshold levels for starting and ending the fine-tuning.

According to an embodiment of the invention, steps d-f are performed continuously during the heating operation.

According to an embodiment of the invention, the frequency tuner 27 and the coupling tuner 22 are driven to predetermined default positions according to the thickness of the planar product 8, and the fine-tuning is performed as in steps a-f. According to an embodiment of the invention, control values for the predetermined default positions are stored in a control unit, the control unit automatically controlling the frequency tuner 27 and the coupling tuner 22 to the predetermined default positions according to the thickness of the planar product 8. According to an embodiment of the invention, the thickness of the planar board is detected automatically.

Example 1

Figure 5:
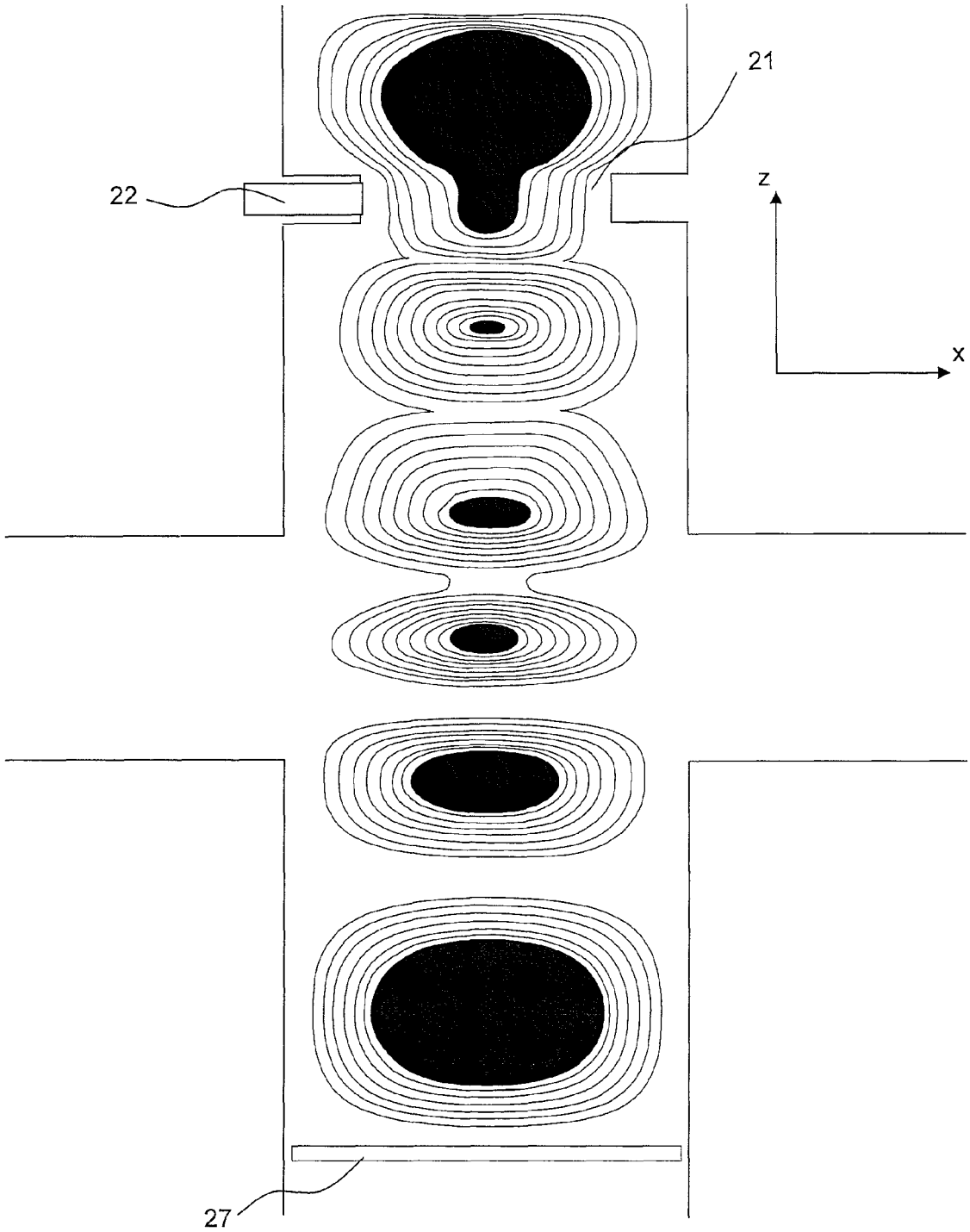
FIG. 5 shows as a simulation result, an average envelope of the electric field in the applicator (x-z plane) with 90 mm thick LVL panel.

A two-and-half-wavelength applicator with 200 mm opening and the maximum electric field in the middle of the LVL (Laminated Veneer Lumber) panel was simulated with the upper part height $h_L$=273 mm. The simulation results after a course tuning are presented in Table 1. These $h_{LL}$ and $w_c$ values may be used as default values. The results can be then enhanced by means of fine-tuning, as described above. FIG. 5 shows the average envelope electric field in x-z plane with 90 mm thick LVL.

TABLE 1

| LVL'S thickness, t [mm] | Lower part height, $h_{LL}$ [mm] | Coupling window width, $w_c$ [mm] | Resonant frequency, $f_r$ [MHz] | Return loss at $f_r$ [dB] |
|---|---|---|---|---|
| 90 | 337 | 158 | 915 | −17.6 |
| 120 | 292 | 156 | 915 | −29.6 |
| 150 | 270 | 156 | 915 | −24.4 |
| 185 | 233 | 156 | 915 | −20.4 |

The example 1 shows that the heating apparatus according to the embodiment of the invention makes it possible to process the planar products in wide range of thickness up to any value between 50 mm to 200 mm or more. A preferred range of thickness is from about 90 mm to about 185 mm. The maximum thickness depends on the selected height of the slot opening, which is in turn is selected on the application basis. The one and same heating apparatus can be easily adjusted for each thickness of the product with the use of the two tuners 22 and 27, without changing the physical length of the applicator 2. Moreover, the same heating apparatus can be adjusted to provide the maximum heating either at the middle of the planar product or at the bottom and top of the product to be heated.

Figure 6:
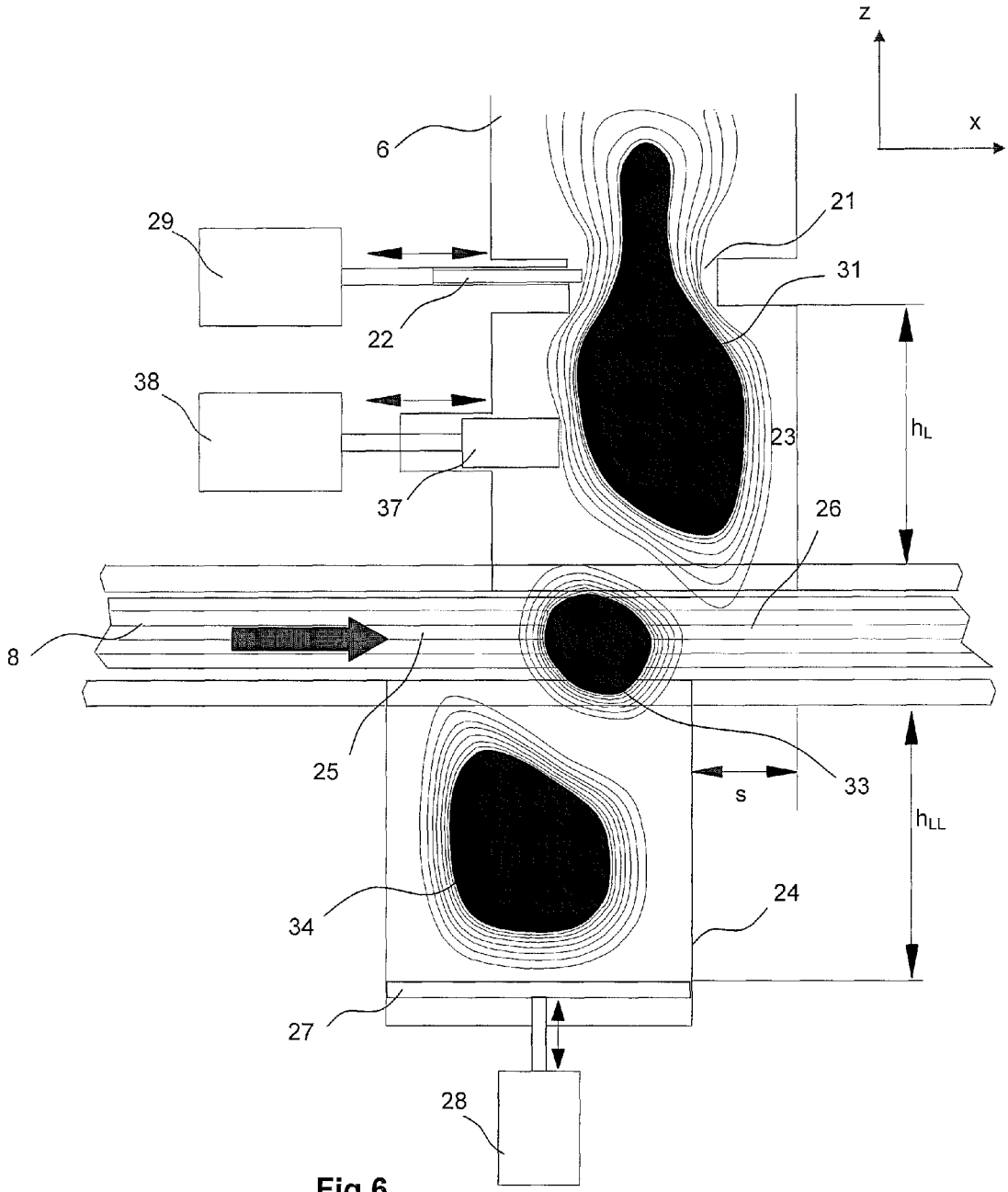
FIG. 6 shows a schematic cross-sectional view of an exemplary applicator 2 according to a still further embodiment of the invention in the x-z.

According to an aspect of the invention, opposed first (upper) part 23 and second (lower) part 24 of the cavity resonator, i.e. subcavities, are shifted or displaced in relation to each other in the direction of travel of the product 8 (the x-axis), as illustrated in FIG. 6. In spite of the shifted subcavities, the structure and operation of the applicator 2 may be similar to any of the embodiments described above. The shifting of upper and lower parts enables manipulation of the field distribution inside the cavity so as to increase vertical heating uniformity in the planar product. The heating middle half-wavelength peak distribution 33 at the middle of the planar product 8 may become narrower in x-direction (i.e. the heating is more effective) and longer in vertical direction (z-axis), which means that the heating is more uniform in the vertical direction (z-axis) over the thickness of the planar product. The shift S should not be large, preferably not more than 10% of the wavelength in the free space at the operating frequency.

Figure 7:
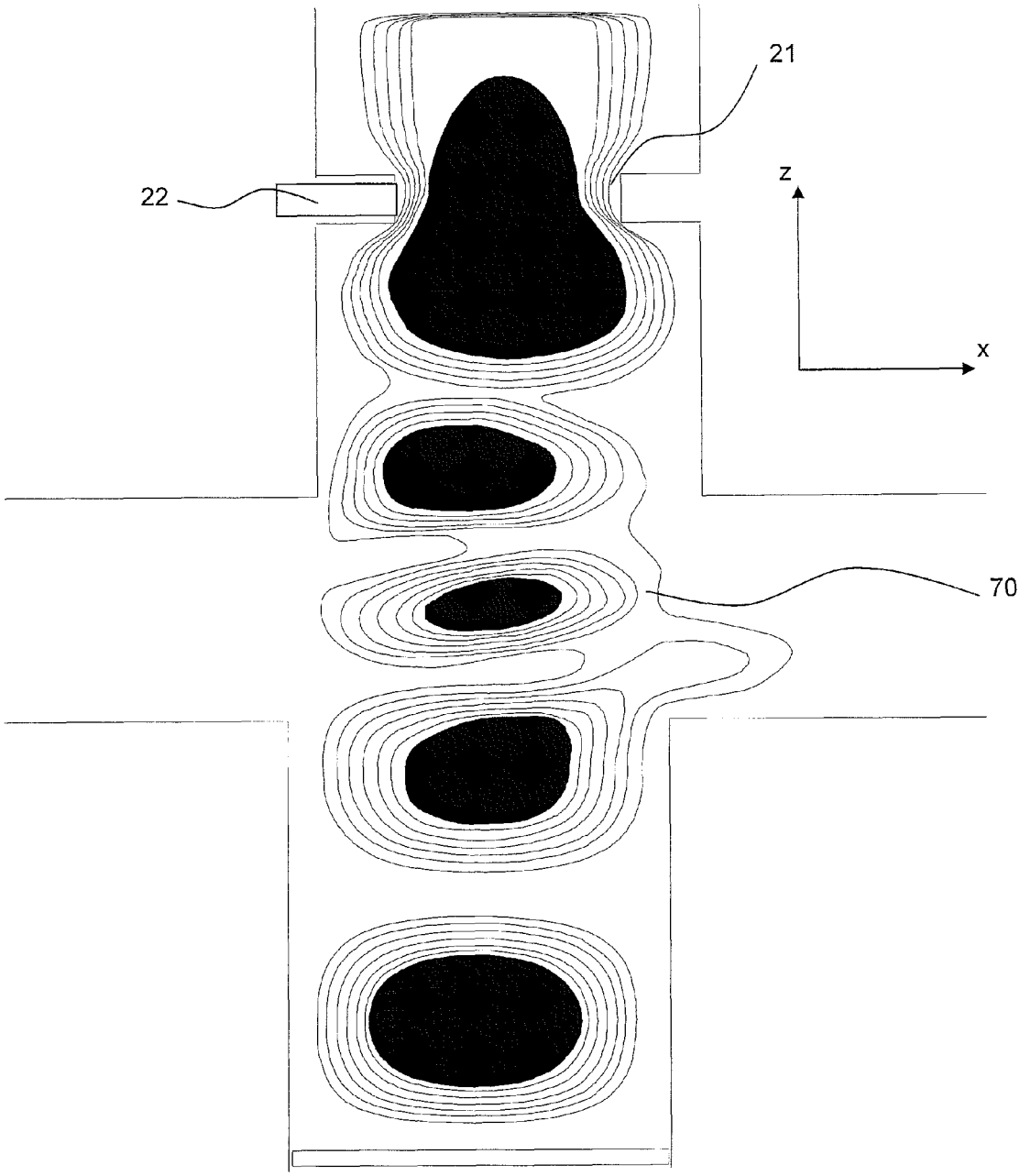
FIG. 7 shows as a simulation result, an average envelope of the electric field in x-z plane with 90 mm LVL panel for the embodiment of FIG. 6.

The shift S may be, for example, in the range of 5 mm to 30 mm, preferably in the range of 10 mm to 30 mm, most preferably in the range of 15 mm to 25 mm. FIG. 7 shows a simulated example of the average envelope electric field in x-z plane for a 90 mm thick LVL in a two-and-half-wavelength applicator with 200 mm opening and 20 mm shift S. The change in the shape of the middle field 70 can be observed in comparison with FIG. 5 in which no shift used.

In a further embodiment of the invention, a further frequency tuning mechanism is provided in the upper subcavity, a shown in FIG. 2. A block 37 of a microwave transparent material, such as Teflon or other dielectric material, is arranged laterally on the same sidewall C*b as the coupling tuner plate 22, such that the protrusion of the tuner block 37 into the subcavity 23 is adjustable in the direction x, i.e. in direction of sidewall a (e.g. the 248 mm side). The y-dimension of block 37 is preferably substantially equal to the internal y-dimension of the subcavity, namely C*b (e.g. 600 mm). The tuner block 37 can be moved in back and forth in the direction of x axis by means an actuator 38, such as a step motor or a hydraulic or pneumatic actuator. This frequency tuner has one degree more freedom in formation of the heating pattern. Especially, when the applicator 2 is implemented by a multi-half-wavelength cavity resonator divided asymmetrically into opposed first (upper) part 23 and second (lower) part 24 of the cavity resonator, i.e. subcavities, such that physical height (length) of the lower subcavity 24 (the one with the frequency tuner) is smaller than the height of the upper subcavity 23 (the one with the coupling tuner 22), it is possible to use only the frequency tuner 37 in the subcavity 23, instead of using the frequency tuner 27, for thin LVL panels (track height not larger than 70 mm). This arrangement results in a better reliability and durability of the applicator, because there is no current flowing between horizontal and vertical walls, there in no need to assure good electrical contact between above-mentioned walls, and only dielectric 37 is shifted.

Figure 8:
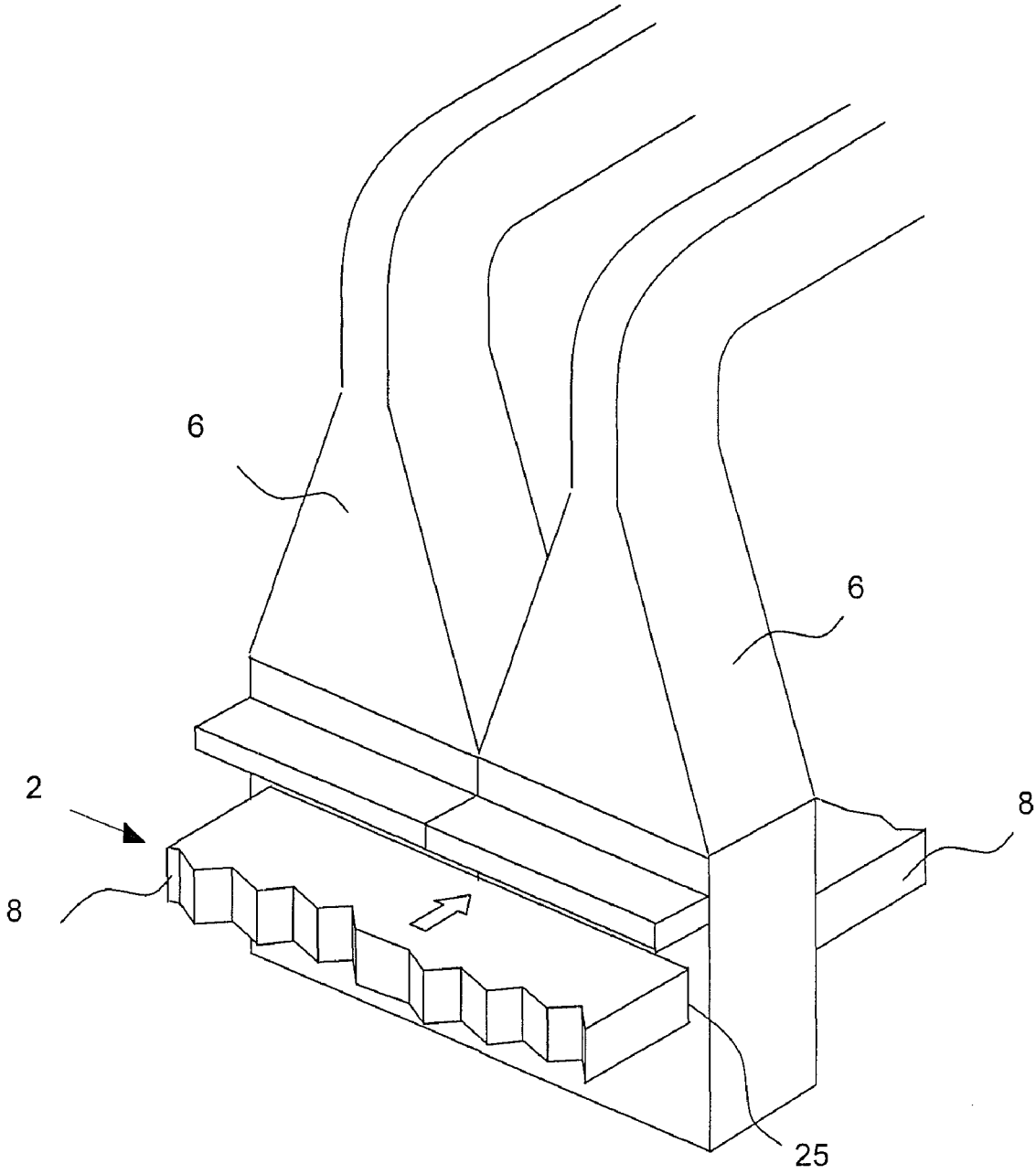
FIG. 8 illustrates an embodiment of the invention, in which two applicators 2 are installed in parallel.

The invention allows implementing a microwave heating for planar products of large range of width, from 30 centimeters up to 1 to 3 meters. The primary limiting factor may be the maximum microwave power available from the generator 7. When the microwave power is distributed wider in the direction of the Y-axis, the smaller is the microwave power per unit of length (e.g. 1 mm) in that direction. Thus, there is a width where the heating power is not sufficient for heating the planar product. According to an embodiment of the invention, an adequate heating of very wide products can be provided by means of installing two or more applicators 2 in parallel, as shown in FIG. 8. Each applicator 2 may be fed from a different generator 7. At the slot openings 25 and 26, the abutting sidewalls of the applicators are removed, resulting in slot openings and product track twice (or more) as wide as in a single applicator 2. Thus, the width of the planar product 8 that can travel through the joined applicators is doubled (or more) in comparison with a single applicator.

While particular example embodiments according to the invention have been illustrated and described above, it will be clear that the invention can take a variety of forms and embodiments within the spirit and scope of the appended claims.

The invention claimed is:

1. An apparatus for microwave heating of a planar product, said apparatus comprising a feeding waveguide having a rectangular cross-section with a first side of length b and a second side of length a, wherein a>b, for feeding a microwave apparatus, an elongated heating cavity having an enlarged rectangular cross-section with a first side of an extended length Cab and a second side of length a, wherein C>2 and C*b>a, a pair of lateral slots provided parallel in said opposite enlarged first walls of said elongated heating cavity and arranged to divide said elongated heating cavity into opposing first and second subcavities in the axial direction of said elongated heating cavity, said lateral slots permitting a planar product to be heated to traverse said elongated heating cavity via said lateral slots, a waveguide transition provided between the feeding waveguide and the heating cavity for transforming said standard rectangular cross-section at the input of the feeding waveguide into said enlarged cross-section of the heating cavity, and for feeding a fundamental mode from feeding waveguide to the first subcavity of the elongated heating cavity via an adjustable coupling iris, a frequency tuning device arranged to move an end wall of the second subcavity in the axial direction so as to tune the frequency of the elongated heating cavity and to move a maximum or minimum of an electric field in the axial direction at about a middle of a thickness of the planar product, a sensor for measuring a microwave power of the fundamental mode reflected from said heating cavity, and a coupling tuning device arranged to adjust a size of the coupling iris in a direction of the second side wall so as to minimize said reflected power from said heating cavity.

2. An apparatus as claimed in claim 1, wherein the first and second subcavities are provided symmetrically with respect to a level defined by the lateral slots.

3. An apparatus as claimed in claim 1, wherein the first and second subcavities are provided asymmetrically with respect to a level defined by the lateral slots.

4. An apparatus as claimed in claim 3, wherein the first subcavity and the second subcavity are shifted a distance of S millimeters in relation to each other in a direction of travel of the planar product to increase a vertical heating uniformity.

5. An apparatus as claimed in claim 1, wherein the first subcavity and the second subcavity are shifted a distance of S millimeters in relation to each other in a direction of travel of the planar product to increase a vertical heating uniformity.

6. An apparatus as claimed in claim 1, wherein the amount of the shift S is in the range of about 10 mm to about 30 mm.

7. An apparatus as claimed in claim 1, wherein the amount of shift S is in the range of about 15 mm to about 25 mm.

8. An apparatus as claimed in claim 1, wherein ends of the subcavities that face the planar product are closed with low-loss dielectric layers.

9. An apparatus as claimed in claim 8, wherein the low-loss dielectric layers comprise polytetrafluoroethylene or a like material.

10. An apparatus as claimed in claim 1, wherein a second frequency tuning mechanism in a form of a block of low-loss dielectric is arranged along the first sidewall of the first subcavity such that a protrusion of the block into the first subcavity is adjustable along the second sidewall.

11. An apparatus as claimed in claim 1, wherein the coupling tuning device comprises an electrically conductive plate provided along the first sidewall and adapted to be moved along the second sidewall so as to adjust the size of the coupling iris in order to minimize said reflected power from the heating cavity.

12. An apparatus as claimed in claim 1, wherein at least one or more parallel heating cavity is attached to said elongated heating cavity, the lateral slot openings being adapted to continue from one heating cavity to another at abutting sidewalls of the heating cavities to form slot openings and a product track at least twice as wide as in a single cavity.

13. An apparatus as claimed in claim 12, wherein each cavity is arranged to be fed from a different microwave generator.

14. An apparatus as claimed in claim 1, wherein the apparatus is adjustable to process planar products of a thickness up to 200 mm.

15. An apparatus as claimed in claim 1, wherein the apparatus is adjustable to process planar products of a thickness of from 50 mm to 200 mm.

16. An apparatus as claimed in claim 1, wherein the apparatus is adjustable to process planar products of a thickness of from 90 mm to about 185 mm.

17. An apparatus as claimed in claim 1, wherein the apparatus is adjustable to process planar products of a width ranging from 30 centimeters up to 3 meters.

18. An apparatus as claimed in claim 1, wherein a=248 mm and b=124 mm.

19. An apparatus as claimed in claim 1, wherein C*b=600 mm.

* * * * *